US011767982B2

(12) United States Patent
Cadima

(10) Patent No.: US 11,767,982 B2
(45) Date of Patent: Sep. 26, 2023

(54) COOKTOP APPLIANCE AND HEATING ELEMENT HAVING A THERMOSTAT

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 377 days.

(21) Appl. No.: 16/932,913

(22) Filed: Jul. 20, 2020

(65) Prior Publication Data

US 2022/0018544 A1 Jan. 20, 2022

(51) Int. Cl.

| | |
|---|---|
| ***F24C 7/06*** | (2006.01) |
| ***H05B 3/76*** | (2006.01) |
| ***F24C 7/08*** | (2006.01) |
| ***H05B 1/02*** | (2006.01) |

(52) U.S. Cl.

CPC ..... *F24C 7/062* (2013.01); *F24C 7/088* (2013.01); *H05B 1/0266* (2013.01); *H05B 3/76* (2013.01); *H05B 2213/07* (2013.01)

(58) Field of Classification Search

CPC ..... F24C 7/062; F24C 7/067; F24C 7/083; F24C 7/088; H05B 1/0266; H05B 2213/07; H05B 3/68; H05B 3/681; H05B 3/70; H05B 3/746; H05B 3/748; H05B 3/76

USPC ..... 219/443.1–468.2

See application file for complete search history.

(56) References Cited

U.S. PATENT DOCUMENTS

| | | | | |
|---|---|---|---|---|
| 2,399,423 A * | 4/1946 | Bletz | F24C 15/105 | 219/457.1 |
| 2,764,661 A * | 9/1956 | Molyneaux | F24C 15/106 | 219/457.1 |
| 2,806,122 A * | 9/1957 | Thunander | G05D 23/1913 | 219/459.1 |
| 3,248,501 A * | 4/1966 | Hire | H01H 37/14 | 337/112 |
| 4,039,991 A * | 8/1977 | Bucheister | H01H 37/5409 | 337/348 |
| 5,176,451 A * | 1/1993 | Sasada | F24C 3/126 | 374/165 |
| 6,246,033 B1 | 6/2001 | Shah | | |
| 10,429,080 B2 | 10/2019 | Pasqual | | |
| 2018/0238559 A1* | 8/2018 | Pasqual | F24C 15/105 | |

FOREIGN PATENT DOCUMENTS

CN 104715971 A 6/2015

* cited by examiner

*Primary Examiner* — Sang Y Paik

(74) *Attorney, Agent, or Firm* — Dority & Manning, P.A.

(57) ABSTRACT

An electric resistance heating coil assembly, as provided herein, may include a spiral would sheathed heating element, a thermostat, and a shroud cover. The spiral wound sheathed heating element may have a first coil section and a second coil section. The thermostat may be connected in series between the first and second coil sections of the spiral wound sheathed heating element. The thermostat may include a base and a top cap. The base may extend axially between a first end and a second end. The top cap may be held on the base at the first end. The shroud cover may be mounted to the thermostat below the top cap.

18 Claims, 7 Drawing Sheets

120

COOKTOP APPLIANCE AND HEATING ELEMENT HAVING A THERMOSTAT

FIELD OF THE INVENTION

The present subject matter relates generally to electric heating elements for appliances, such as for cooktop or range appliances.

BACKGROUND OF THE INVENTION

Cooking appliances that include a cooktop traditionally have at least one heating element (e.g., electric coil heating element) positioned on a panel proximate a cooktop surface for use in heating or cooking an object, such as a cooking utensil, and its contents. Recent regulatory requirements mandate that electric coil heating elements on cooktop appliances be incapable of heating cooking oil to an oil ignition temperature. Thus, certain electric coil heating elements use a bimetallic thermostat to interrupt power to the coil when the thermostat reaches a tripping point. In some cooktops, the thermostat is remotely positioned from the utensil or cookware and infers the cookware temperature through correlation. In other cooktops, the thermostat contacts a bottom of the cookware to improve correlation. However, whether remotely positioned from the cookware or contacting the cookware, imperfect correlation requires conservative thermostat calibrations and thus results in reduced performance.

Known coil heating elements using bimetallic thermostats have shortcomings. In particular, the flatness of the coil has a significant impact to system performance, as does the flatness of the bottom of the cookware. Poor contact between the cookware and the coil cause the portions of the coil that have poor conduction to the cookware to glow red hot and radiate heat. Radiative heat transfer from the coil to the thermostat can overcome the heat transfer from the cookware to the thermostat, causing the thermostat to trip early.

As a result, it would be useful to have a cooktop appliance addressing one or more of the above identified issues. In particular, it may be advantageous to provide a cooktop appliance having a thermostat with one or more features for enhancing contact (e.g., with a utensil on a heating element) or conductive heat transfer from a utensil to a thermostat (e.g., without being unduly affected by radiative heat transfer from the heating element).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an electric resistance heating coil assembly is provided. The electric resistance heating coil assembly may include a spiral would sheathed heating element, a thermostat, and a shroud cover. The spiral wound sheathed heating element may have a first coil section and a second coil section. The thermostat may be connected in series between the first and second coil sections of the spiral wound sheathed heating element. The thermostat may include a base, a top cap, and a support flange. The base may extend axially between a first end and a second end. The top cap may be held on the base at the first end. The support flange may be held on the base apart from the top cap between the second end and the top cap. The shroud cover may be mounted to the thermostat below the top cap at the support flange.

In another exemplary aspect of the present disclosure, an electric resistance heating coil assembly is provided. The electric resistance heating coil assembly may include a spiral would sheathed heating element, a thermostat, and a shroud cover. The spiral wound sheathed heating element may have a first coil section and a second coil section. The thermostat may be connected in series between the first and second coil sections of the spiral wound sheathed heating element. The thermostat may include a base and a top cap. The base may extend axially between a first end and a second end. The top cap may be held on the base at the first end. The shroud cover may be mounted to the thermostat below the top cap. The base may define a first outer diameter proximal to the first end and a second outer diameter proximal to the second end below the top cap. The second outer diameter may be smaller than the first outer diameter.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
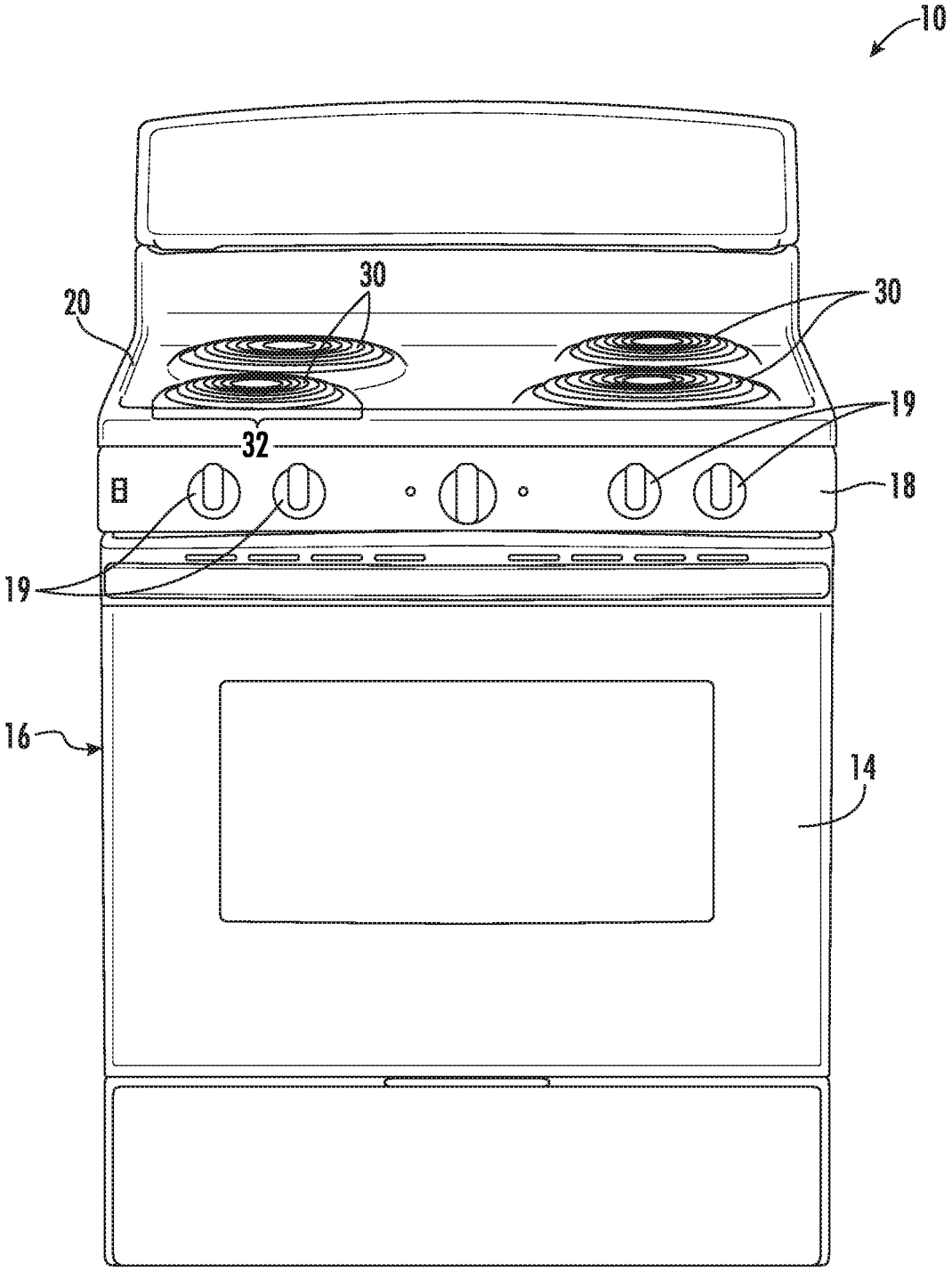
FIG. 1 provides a front perspective view of a range appliance according to exemplary embodiments of the present disclosure.
Figure 2:
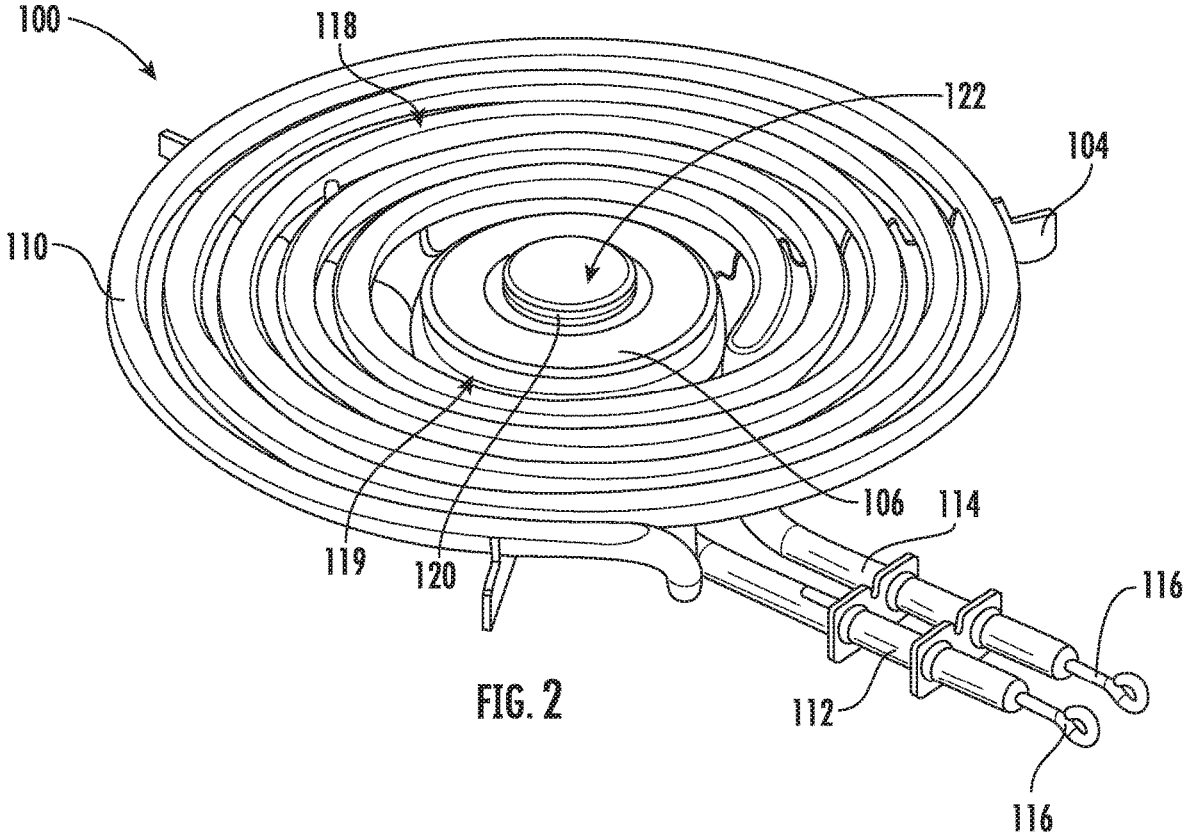
FIG. 2 provides a top perspective view of an electric resistance heating coil assembly of the exemplary range appliance of FIG. 1.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Turning now to the figures, FIG. 1 provides a front perspective view of a range appliance 10 according to exemplary embodiments of the present disclosure. Range appliance 10 is provided by way of example only and is not intended to limit the present subject matter to the particular arrangement shown in FIG. 1. Thus, the present subject matter may be used with other cooktop appliance configurations (e.g., double oven range appliances, standalone cooktop appliances, etc.).

Generally, a top panel 20 of range appliance 10 includes one or more heating elements 30. Heating elements 30 may be, for example, electrical resistive heating elements. Range appliance 10 may include only one type of heating element 30, or range appliance 10 may include a combination of different types of heating elements 30, such as a combination of electrical resistive heating elements and gas burners. Further, heating elements 30 may have any suitable shape and size, and a combination of heating elements 30 of different shapes and sizes may be used.

Generally, each heating element 30 defines a heating zone 32 on which a cooking utensil, such as a pot, pan, or the like, may be placed to cook or heat food items placed in the cooking utensil. In some embodiments, range appliance 10 also includes a door 14 that permits access to a cooking chamber 16 of range appliance 10 (e.g., for cooking or baking of food items therein). A control panel 18 having controls 19 permits a user to make selections for cooking of food items—although shown on a front panel of range appliance 10, control panel 18 may be positioned in any suitable location. Controls 19 may include buttons, knobs, and the like, as well as combinations thereof. As an example, a user may manipulate one or more controls 19 to select a temperature or a heat or power output for each heating element 30.

Figure 3:
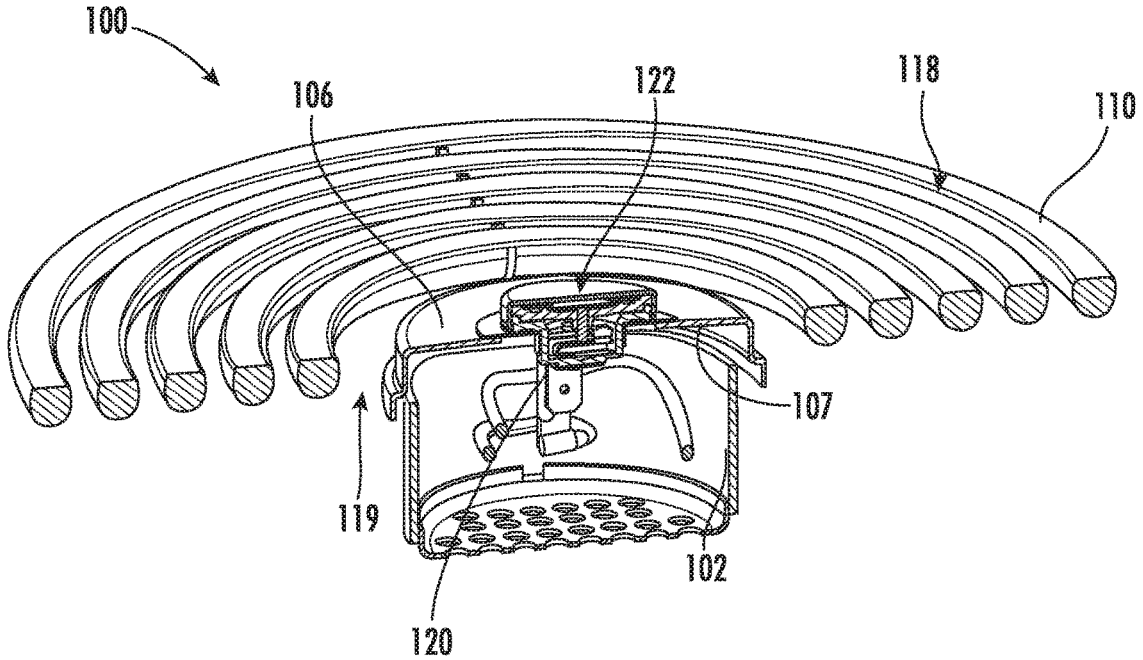
FIG. 3 provides a sectional perspective view of the exemplary electric resistance heating coil assembly of FIG. 2.
Figure 4:
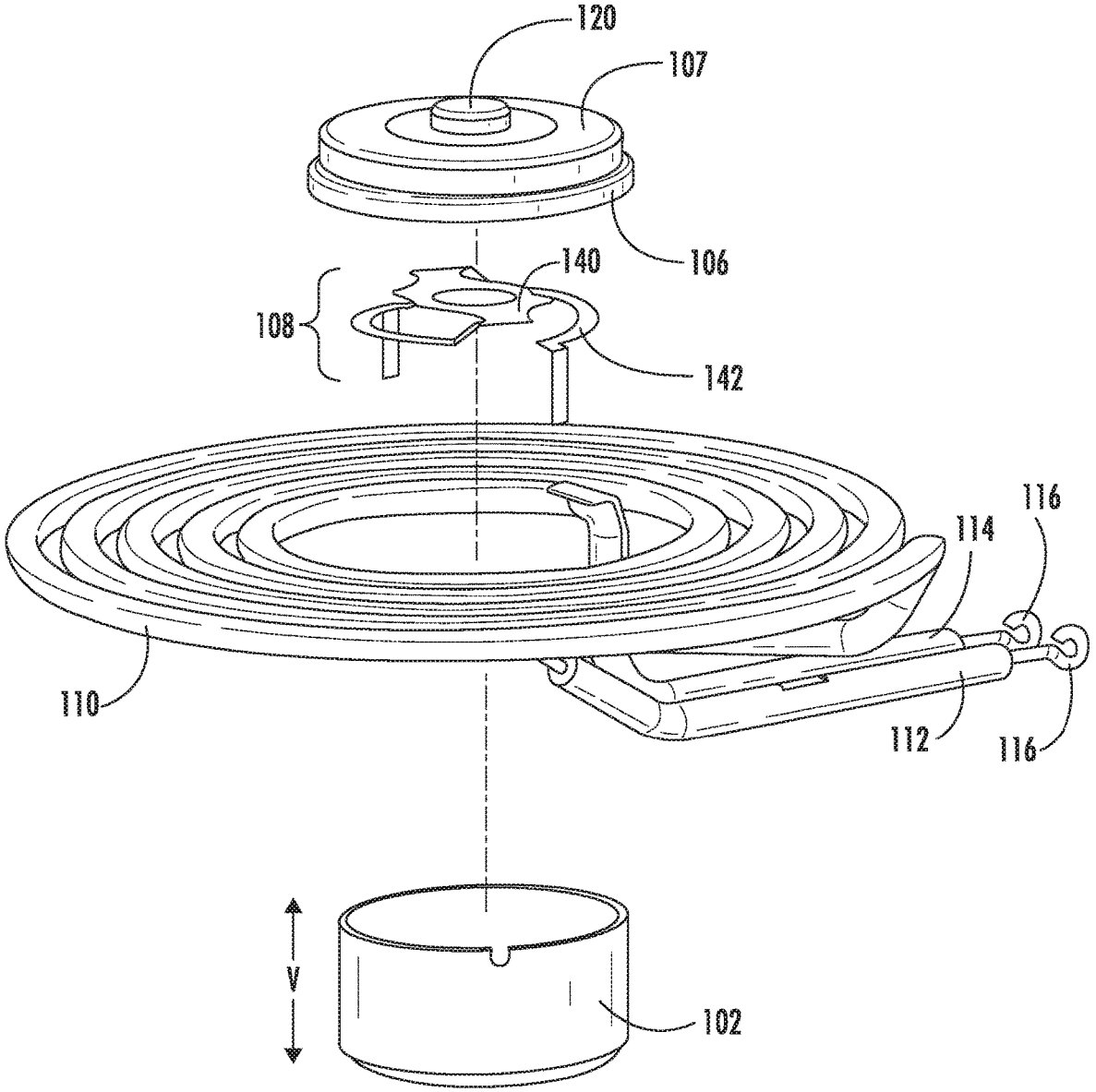
FIG. 4 provides an exploded perspective view of a portion of the exemplary heating coil assembly of FIG. 2.
Figure 5:
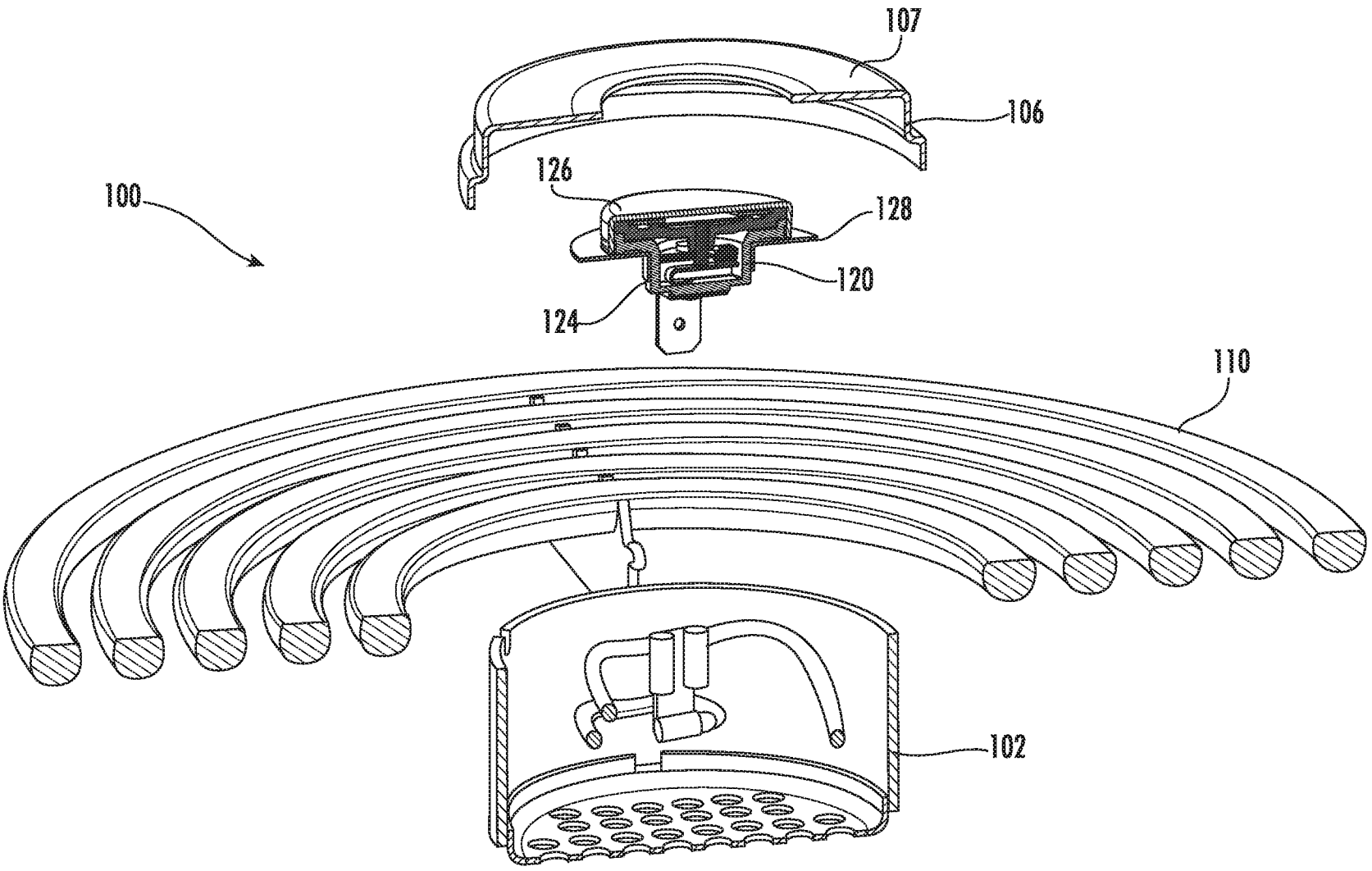
FIG. 5 provides an exploded, sectional, perspective view of a portion of the exemplary heating coil assembly of FIG. 2.

Turning now to FIGS. 2 through 5, FIG. 2 provides a top perspective view of an electric resistance heating coil assembly 100 of range appliance 10. FIG. 3 provides a sectional view of electric resistance heating coil assembly 100. FIG. 4 provides an exploded perspective view of a portion of electric resistance heating coil assembly 100. FIG. 5 provides an exploded, sectional perspective view of a portion of electric resistance heating coil assembly 100.

Electric resistance heating coil assembly 100 may be used as one or more of heating elements 30 in range appliance 10. However, while described in greater detail below in the context of range appliance 10, it will be understood that electric resistance heating coil assembly 100 may be used in or with any suitable cooktop appliance in alternative example embodiments. As discussed in greater detail below, electric resistance heating coil assembly 100 includes features for facilitating conductive heat transfer between a thermostat (e.g., bimetallic thermostat 120) and a utensil positioned on electric resistance heating coil assembly 100.

As shown, some embodiments of electric resistance heating coil assembly 100 include a spiral wound sheathed heating element 110. Spiral wound sheathed heating element 110 may include a first coil section 112 and a second coil section 114. In certain embodiments, spiral wound sheathed heating element 110 also has a pair of terminals 116. Each of first and second coil sections 112, 114 may be directly coupled or connected to a respective terminal 116. A voltage differential across terminals 116 induces an electrical current through spiral wound sheathed heating element 110, and spiral wound sheathed heating element 110 may increase in temperature by resisting the electrical current through spiral wound sheathed heating element 110.

Within the heating zone 32, a sensor support assembly, including thermostat 120, is positioned. When assembled, bimetallic thermostat 120 is connected, for example, in series between first and second coil sections 112, 114 of spiral wound sheathed heating element 110 (e.g., at a pair of discrete thermostat terminals 131, 133, as would be understood). Bimetallic thermostat 120 opens and closes in response to a temperature of bimetallic thermostat 120. For example, bimetallic thermostat 120 may be spring loaded such that a distal end 122 of bimetallic thermostat 120 is urged away from a top surface 118 of spiral wound sheathed heating element 110. Thus, distal end 122 of bimetallic thermostat 120 may be urged towards or against a utensil (not shown) positioned on top surface 118 of spiral wound sheathed heating element 110. Bimetallic thermostat 120 may respond to the temperature of the utensil on top surface 118 of spiral wound sheathed heating element 110 due to heat transfer between the utensil and bimetallic thermostat 120.

In some embodiments, bimetallic thermostat 120 is positioned concentrically with a center 119 of spiral wound sheathed heating element 110. For instance, center 119 of spiral wound sheathed heating element 110 may be open, and spiral wound sheathed heating element 110 may extend circumferentially around bimetallic thermostat 120 at center 119.

The sensor support assembly may also include a shroud 102 and coil support arms 104. As shown, the coil support arms 104 may extend (e.g., radially) from shroud 102, and spiral wound sheathed heating element 110 is positioned on and supported by the coil support arms 104. When assembled, the coil support arms 104 may rest on top panel 20 to support electric resistance heating coil assembly 100 on top panel 20. Bimetallic thermostat 120 may be mounted to a shroud cover 106 below top cap 126. For instance, a support flange 128 of thermostat 120, which may extend radially from base 124 or top cap 126, may be joined to shroud cover 106 (e.g., on a top wall 107 of shroud cover 106).

When assembled, support flange 128 may be positioned below at least a portion of heating element 110 (e.g., below top surface 118). Moreover, shroud cover 106 is positioned below top cap 126. Additionally or alternatively, shroud cover 106 may extend over shroud 102. In particular, a top of shroud 102 may be held radially inward from an outer edge of shroud cover 106. For instance, a top of shroud 102 may be nested in shroud cover 106. When assembled, shroud 102, including shroud cover 106, generally shields bimetallic thermostat 120 from at least a portion of the heat generated at spiral wound sheathed heating element 110.

Optionally, shroud 102, including shroud cover 106, is formed from a relatively low thermal conductivity metal (e.g., steel or a steel alloy). Additionally or alternatively, support flange 128 may be formed from a common material with and joined, for example, to shroud cover 106 (e.g., via welding or a suitable mechanical fastener, such as a screw or rivet). Also additionally or alternatively, support flange 128 and top cap 126 are formed of, or include, distinct materials. For instance, support flange 128 may be formed from a first material, such as a relatively low thermal conductivity metal (e.g., steel, including alloys thereof), while top cap 126 is formed from a second material, such as a relatively high thermal conductivity metal (e.g., aluminum, copper, a copper alloy, or an aluminum alloy). Top cap 126 may thus absorb and conduct heat faster or more readily than support flange 128.

In some embodiments, a spring bracket 108 biases shroud cover 106 and bimetallic thermostat 120 thereon upwardly. As shown, spring bracket 108 may include a mounting plate 140 and one or more biasing arms 142 extending therefrom. When assembled, bimetallic thermostat 120 is mounted or fixed to mounting plate 140. For instance, bimetallic thermostat 120 can be welded, clipped, or otherwise attached to mounting plate 140 with mechanical fasteners (e.g., screws or rivets), or a combination thereof. Biasing arms 142 may be resilient members, which generally urge mounting plate 140 upward. Spring bracket 108, including biasing arms 142, may be formed from any suitable high yield strength material. For instance, spring bracket 108 is formed of a stainless steel, full hard, or spring tempered material. Spring bracket 108 can be formed of other suitable high yield strength materials as well.

Figure 6:
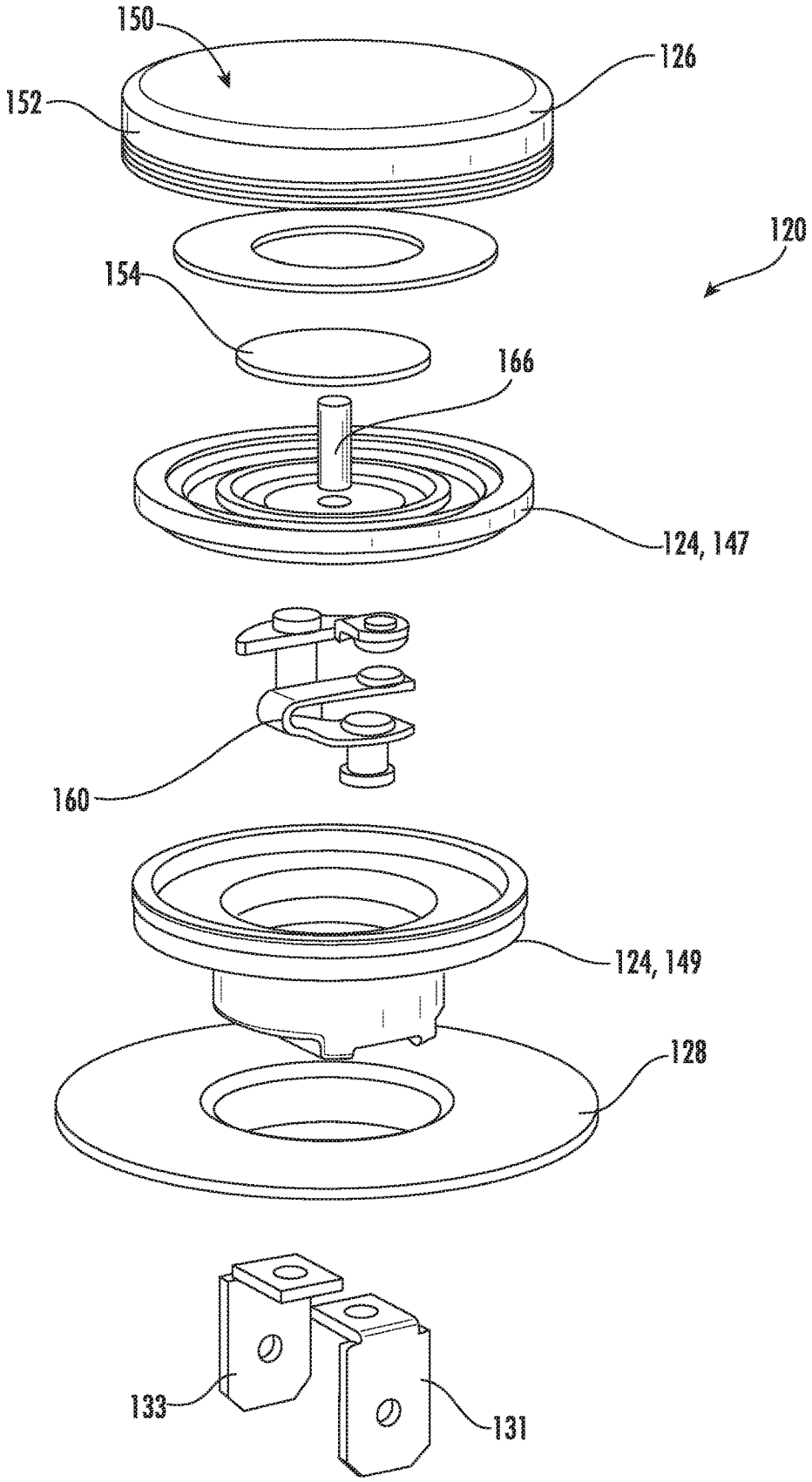
FIG. 6 provides an exploded perspective view of the bimetallic thermostat of the exemplary heating coil assembly of FIG. 2.
Figure 7:
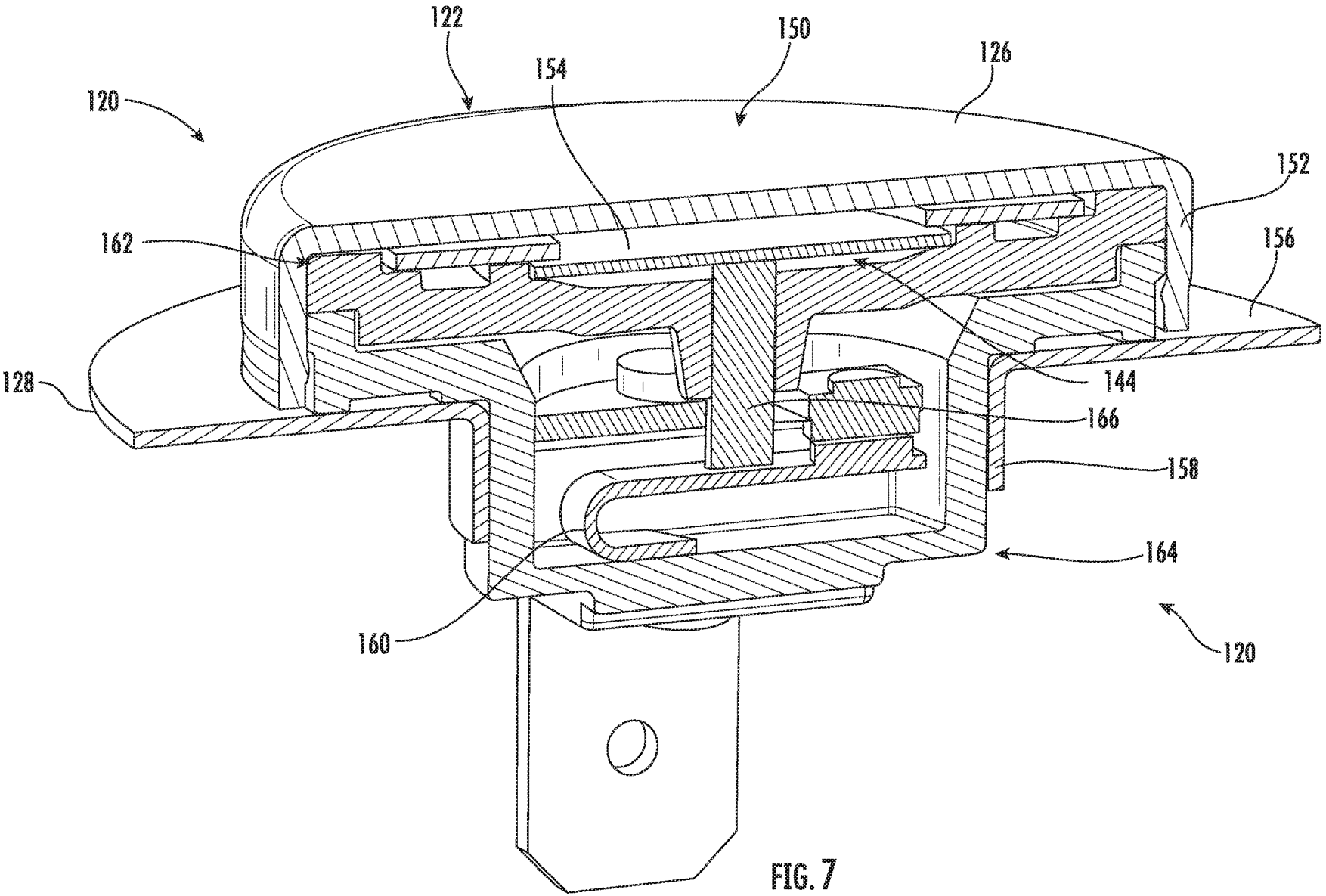
FIG. 7 provides a sectional perspective view of the bimetallic thermostat of the exemplary heating coil assembly of FIG. 2.
Figure 8:
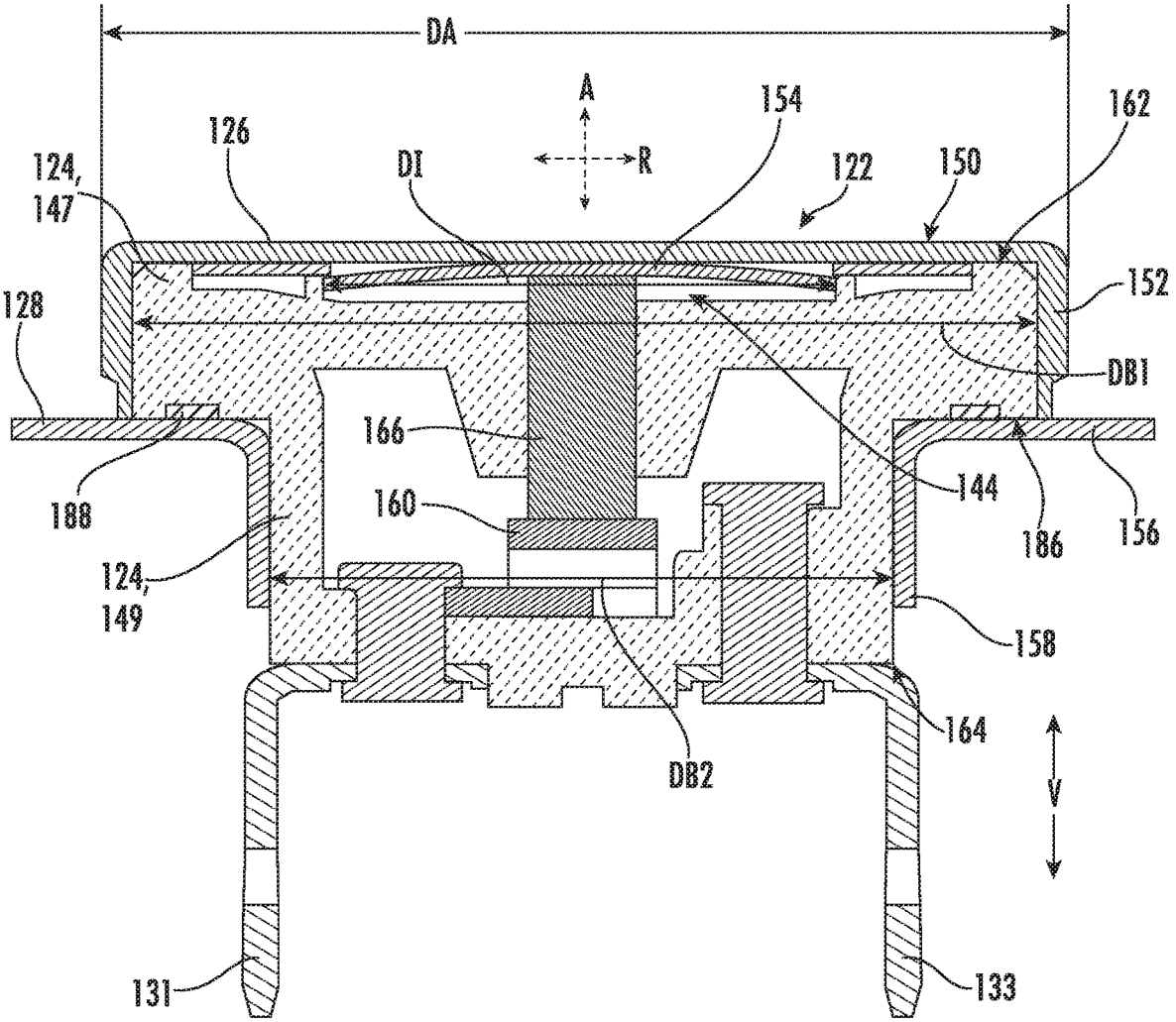
FIG. 8 provides a sectional elevation view of the bimetallic thermostat of the exemplary heating coil assembly of FIG. 2.

Turning now to FIGS. 6 through 8, various views are provided of bimetallic thermostat 120 (or portions thereof). In particular, FIG. 6 provides an exploded perspective view of bimetallic thermostat 120. FIGS. 7 and 8 provide sectional views of bimetallic thermostat 120.

As shown, bimetallic thermostat 120 includes a discrete base 124 and top cap 126 that is held on base 124. Base 124 extends axially (e.g., along an axial direction A or parallel to the vertical direction V) between a first (e.g., upper) end 162 and a second (e.g., lower) end 164. For instance, at least a portion of top cap 126 may extend above base 124 (e.g., at the first end 162) and define an uppermost surface (e.g., at upper surface 150) of bimetallic thermostat 120 at distal end 122. Top cap 126 may be seated on top of or over base 124.

In some embodiments, base 124 defines multiple outer diameters (e.g., along a horizontal or radial direction R) such that one portion of the base 124 is wider than another. Specifically, a top portion of base 124 may be wider than a bottom portion of base 124. In turn, a first outer diameter DB1 (e.g., radial maximum) may be defined at or proximal to first end 162 while a smaller second outer diameter DB2 (e.g., radial maximum) is defined at or proximal to second end 164. For instance, first outer diameter DB1 may be no less than 1.5 times greater than second outer diameter DB2. Additionally or alternatively, first outer diameter DB1 may be no more than 5 times greater than second outer diameter DB2. Top cap 126 may be mounted to base 124 at first outer diameter DB1 and, thus, have a cap diameter DA that is greater than or equal to first outer diameter DB1. Advantageously, the thermal mass of base 124 may be reduced (e.g., while maintain a relatively large or wide top cap 126), which may otherwise impede the responsiveness of thermostat 120.

In some embodiments, base 124 and top cap 126 are formed of, or include, distinct materials. For instance, base 124 may be formed from a substrate material, such as a thermally insulating or heat-resistant material (e.g., a ceramic material), while top cap 126 is formed from a second material, such as a relatively high thermal conductivity metal (e.g., including silver, copper, or aluminum, including alloys thereof). Top cap 126 may thus absorb and conduct heat faster or more readily than base 124.

In some embodiments, top cap 126 is press fitted on top of base 124 (e.g., at first end 162). Optionally, top cap 126 may cover multiple segments of base 124, such as an upper frame 147 and a lower frame 149. In some embodiments, top cap 126 includes an upper surface 150 that extends across base 124 and a cap wall 152 that extends downwardly from upper surface 150 around base 124. Optionally, base 124 may define a central opening 144 (e.g., within which a bimetallic disk 154 is disposed). Thus, the upper surface 150 of top cap 126 may extend across and close central opening 144 while cap wall 152 contacts base 124, holding upper surface 150 in place.

As noted above, when assembled, shroud cover 106 is positioned below top cap 126. In particular, shroud cover 106 may be spaced apart from top cap 126. Although both shroud cover 106 and top cap 126 are generally attached to base 124, shroud cover 106 may be mounted at another portion of base 124. For instance, support flange 128 may be mounted below top cap 126. Flange 128 may, in turn, be mounted to a smaller portion of base 124 (e.g., at second outer diameter DB2). In some such embodiments, support flange 128 is spaced apart from top cap 126. For instance, support flange 128 may be positioned below shroud cover 106 or vertical air gap AG.

In certain embodiments, support flange 128 includes an attachment lip 156 and a flange wall 158. As shown, attachment lip 156 may extend radially outward from base 124 (e.g., below shroud cover 106 or along a bottom-facing radial surface 186). Additionally or alternatively, flange wall 158 may extend from attachment lip 156 (e.g., downward) around base 124. Optionally, flange wall 158 may be held to an outer surface of base 124 at second end 164. For instance, flange wall 158 may be press fitted to a bottom portion of base 124 (e.g., at a portion of lower frame 149 that defines second outer diameter DB2). Thus, attachment lip 156 of support flange 128 may extend (e.g., radially) from base 124 apart from top cap 126 while flange wall 158 contacts base 124 below and apart from cap wall 152, holding attachment lip 156 in place. Advantageously, thermostat 120 may prevent heat from being conducted between top cap 126 and support flange 128 or shroud cover 106. In turn, heat (e.g., radiative heat) absorbed at shroud cover 106 may be prevented from unduly influencing the temperature of (or detected at) top cap 126.

As shown, attachment lip 156 may extend along a bottom-facing radial surface 186. For instance, attachment lip 156 may abut bottom-facing radial surface 186. Moreover, attachment lip 156 may extend radially outward from (e.g., further along a radial direction R than) first outer diameter DB1. Optionally, a circumferential gasket 188 may be disposed between at least a portion of bottom-facing radial surface 186 and attachment lip 156. In some embodiments, circumferential gasket 188 is received within a circumferential groove defined in base 124 (e.g., within a portion of lower frame 149 radially outward from second outer diameter DB2). Generally, circumferential gasket 188 seals an interior portion of thermostat 120 (e.g., to prevent liquid from flowing along attachment lip 156 beneath bottom-facing radial surface 186).

Within base 124, bimetallic disk 154 may be mounted or otherwise positioned proximal to the first end 162 or top cap 126 (e.g., to expand/contract at predetermined temperature, as is understood). Generally, bimetallic disk 154 defines a disk diameter DI (e.g., along the radial direction R) that is less than the cap diameter DA. In some embodiments, disk diameter DI is substantially smaller than the cap diameter DA. For instance, cap diameter DA may be no less than 1.5 times greater than disk diameter DI. Additionally or alternatively, cap diameter DA may be no more than 5 times greater than disk diameter DI. Optionally, disk diameter DI may be less than second outer diameter DB2. Advantageously, the thermal mass of bimetallic thermostat 120 may be reduced (e.g., while maintain a relatively large or wide top cap 126), which may otherwise impede the responsiveness of thermostat 120.

As shown, a conductive spring 160 may be disposed further disposed within base 124 and in biased engagement with bimetallic disk 154. For instance, conductive spring 160 may be mounted below bimetallic disk 154 (e.g., proximal to second end 164). Conductive spring 160 may generally positioned between the second end 164 and bimetallic disk 154. Optionally, conductive spring 160 is held within lower frame 149. Additionally or alternatively, conductive spring 160 may be positioned below upper frame 147 while bimetallic disk 154 is positioned above at least a portion of upper frame 147 (e.g., such that upper frame 147 insulates conductive spring 160 from bimetallic disk 154 or central opening 144). Further additionally or alternatively, a support rod 166 may extend (e.g., axially or along axial direction A) between conductive spring 160 (e.g., at a top lever of conductive spring 160) and bimetallic disk 154. For instance, support rod 166 may extend through an axial channel in base 124 (e.g., defined through upper frame 147) such that movement or biasing forces are transferred from conductive spring 160 to bimetallic disk 154 (and vice versa).

When assembled, conductive spring 160 may be in biased engagement with bimetallic disk 154 to motivate the bimetallic disk 154 towards the first end 162 within the base 124. In the illustrated embodiments, conductive spring 160 is formed as a cantilever spring having a pair of support levers connected by an integral fulcrum joint.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An electric resistance heating coil assembly, comprising:

a spiral wound sheathed heating element having a first coil section and a second coil section;

a thermostat connected in series between the first and second coil sections of the spiral wound sheathed heating element, the thermostat comprising a base extending axially between a first end and a second end, the base defining a central opening at the first end, a top cap held on the base at the first end, a bimetallic disk disposed within the central opening and defining a disk diameter along a radial direction, and a support flange held on the base apart from the top cap between the second end and the top cap; and a shroud cover mounted to the thermostat below the top cap at the support flange, wherein the base defines a first outer diameter proximal to the first end and a second outer diameter proximal to the second end, wherein the second outer diameter is smaller than the first outer diameter, wherein the support flange is held on the base at the second outer diameter, and wherein the top cap defines a cap diameter along the radial direction above the bimetallic disk, and wherein the cap diameter is no less than one and a half times greater than the disk diameter.

2. The electric resistance heating coil assembly of claim 1, wherein the support flange is positioned below a top surface of the spiral wound sheathed heating element.

3. The electric resistance heating coil assembly of claim 1, further comprising a spring bracket mounted to the thermostat below the shroud cover.

4. The electric resistance heating coil assembly of claim 1, wherein the support flange comprises a first material, and wherein the top cap comprises a second material distinct from the first material.

5. The electric resistance heating coil assembly of claim 4, wherein the first material comprises steel or a steel alloy, and wherein the second material comprises aluminum, copper, a copper alloy, or an aluminum alloy.

6. The electric resistance heating coil assembly of claim 4, wherein the base comprises a substrate material that is distinct from the first material and the second material.

7. The electric resistance heating coil assembly of claim 6, wherein the substrate material comprises a ceramic material.

8. The electric resistance heating coil assembly of claim 1, wherein the first outer diameter is no less than one and a half times greater than the second outer diameter.

9. An electric resistance heating coil assembly, comprising:

a spiral wound sheathed heating element having a first coil section and a second coil section;

a thermostat connected in series between the first and second coil sections of the spiral wound sheathed heating element, the thermostat comprising a base extending axially between a first end and a second end, a top cap held on the base at the first end, and a bimetallic disk disposed within the central opening below the top cap and defining a disk diameter along a radial direction; and a shroud cover mounted to the thermostat below the top cap, wherein the base defines a first outer diameter proximal to the first end and a second outer diameter proximal to the second end below the top cap, wherein the second outer diameter is smaller than the first outer diameter, wherein the support flange is held on the base at the second outer diameter, and wherein the top cap defines a cap diameter along the radial direction above the bimetallic disk, and wherein the cap diameter is no less than one and a half times greater than the disk diameter.

10. The electric resistance heating coil assembly of claim 9, wherein the thermostat further comprises a support flange held on the base at the second outer diameter.

11. The electric resistance heating coil assembly of claim 10, wherein the support flange is positioned below a top surface of the spiral wound sheathed heating element.

12. The electric resistance heating coil assembly of claim 9, further comprising a spring bracket mounted to the thermostat below the shroud cover.

13. The electric resistance heating coil assembly of claim 10, wherein the support flange comprises a first material, and wherein the top cap comprises a second material distinct from the first material.

14. The electric resistance heating coil assembly of claim 13, wherein the first material comprises steel or a steel alloy, and wherein the second material comprises aluminum, copper, a copper alloy, or an aluminum alloy.

15. The electric resistance heating coil assembly of claim 13, wherein the base comprises a substrate material that is distinct from the first material and the second material.

16. The electric resistance heating coil assembly of claim 15, wherein the substrate material comprises a ceramic material.

17. The electric resistance heating coil assembly of claim 9, wherein the first outer diameter is no less than one and a half times greater than the second outer diameter.

18. An electric resistance heating coil assembly, comprising:

a spiral wound sheathed heating element having a first coil section and a second coil section;

a thermostat connected in series between the first and second coil sections of the spiral wound sheathed heating element, the thermostat comprising a base extending axially between a first end and a second end, the base defining a central opening at the first end, a top cap held on the base at the first end, a bimetallic disk disposed within the central opening and defining a disk diameter along a radial direction, the bimetallic disk being radially restrained by the central opening, and a support flange held on the base apart from the top cap between the second end and the top cap; and a shroud cover mounted to the thermostat below the top cap at the support flange, wherein the base defines a first outer diameter proximal to the first end and a second outer diameter proximal to the second end, wherein the top cap defines a cap diameter along the radial direction above the bimetallic disk, wherein the second outer diameter is smaller than the first outer diameter, wherein the cap diameter is no less than one and a half times greater than the disk diameter, and wherein the top cap defines a cap diameter along the radial direction above the bimetallic disk, and wherein the cap diameter is no less than one and a half times greater than the disk diameter.

* * * * *